US012799618B2

(12) United States Patent
Jayaraju et al.

(10) Patent No.: US 12,799,618 B2
(45) Date of Patent: Nov. 17, 2026

(54) METHOD OF FILLING THROUGH-HOLES TO REDUCE VOIDS

(71) Applicant: Rohm and Haas Electronic Materials LLC, Marlborough, MA (US)

(72) Inventors: Nagarajan Jayaraju, South Grafton, MA (US); Derek J. Thoresen, Acton, MA (US); Joanna J. Dziewiszek, Littleton, MA (US); Jimmy John, Northborough, MA (US); Zuhra I. Niazimbetova, Westborough, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 505 days.

(21) Appl. No.: 18/162,971

(22) Filed: Feb. 1, 2023

(65) Prior Publication Data

US 2023/0279577 A1 Sep. 7, 2023

Related U.S. Application Data

(60) Provisional application No. 63/316,517, filed on Mar. 4, 2022.

(51) Int. Cl.

| | |
|---|---|
| ***C25D 5/18*** | (2006.01) |
| ***C25D 3/38*** | (2006.01) |
| ***C25D 7/00*** | (2006.01) |

(52) U.S. Cl.

CPC ..... *C25D 5/18* (2013.01); *C25D 3/38* (2013.01); *C25D 7/00* (2013.01)

(58) Field of Classification Search

None

See application file for complete search history.

(56) References Cited

U.S. PATENT DOCUMENTS

| | | | | |
|---|---|---|---|---|
| 10,501,860 | B2 | 12/2019 | Fujiwara et al. | |
| 11,015,257 | B2 | 5/2021 | Fujiwara et al. | |
| 2015/0156888 | A1* | 6/2015 | Kawai | C25D 7/00 205/125 |
| 2015/0289387 | A1 | 10/2015 | Mirkovic et al. | |
| 2016/0105975 | A1 | 4/2016 | Jayaraju et al. | |
| 2016/0270241 | A1 | 9/2016 | Reents et al. | |
| 2018/0010258 | A1* | 1/2018 | Fujiwara | C25D 5/18 |
| 2021/0130970 | A1* | 5/2021 | Desalvo | C25D 7/00 |

FOREIGN PATENT DOCUMENTS

| | | | |
|---|---|---|---|
| WO | 2021107409 | A1 | 6/2021 |

OTHER PUBLICATIONS

Search Report for corresponding EP Application No. 23158576.1 dated Jul. 7, 2023.

Search Report for corresponding CN Application No. 202310168501.X, dated Apr. 10, 2026.

* cited by examiner

*Primary Examiner* — Stefanie S Wittenberg

(74) *Attorney, Agent, or Firm* — Jonathan D. Baskin; John J. Piskorski

(57) ABSTRACT

Through-holes of a substrate are initially plated with copper to form an incomplete bridge in the middle of the through-holes by a phase shift pulse plating process on both sides of the substrate simultaneously. This is followed by pulse plating the entire substrate to complete the filling of the through-holes.

9 Claims, 5 Drawing Sheets

METHOD OF FILLING THROUGH-HOLES TO REDUCE VOIDS

FIELD OF THE INVENTION

The present invention is directed to a method of filling through-holes to reduce voids by phase shift pulse plating. More specifically, the present invention is directed to a method of filling through-holes to reduce voids by phase shift pulse plating by forming a partial bridge in the through-holes followed by complete filling of the through-holes by pulse plating reverse.

BACKGROUND OF THE INVENTION

Filling through-holes by copper plating has become more and more difficult with higher aspect ratio through-holes. This results in larger voids and potentially other defects. Another problem with through-hole filling is the way the through-holes fill. Unlike vias, which are closed at one end, through-holes pass through a substrate and are open at two ends. Vias fill from bottom to top. In contrast, through-holes fill by forming a complete copper bridge at the center of the through-hole ("butterfly" formation), as illustrated in FIG. 4, followed by filling the two vias formed on either side of the copper through-hole bridge. Direct Current (DC) plating can fill 200 μm thick and 100 μm diameter through-holes, aspect ratio=2, at a constant current density plating of 1.5 or 2 amps/dm$^2$ (ASD). FIG. 5 illustrates a conventional DC waveform. As the aspect ratio increases it becomes more challenging to fill the through-holes and DC plating only results in conformal fill. For example, 900 μm thick and 250 μm diameter through-holes, aspect ratio=3.6, and 900 μm thick and 150 μm diameter through-holes, aspect ratio=6.0, are harder to fill than through-holes with an aspect ratio=2. Often the copper fails to completely fill the through-hole and both ends remain unfilled and voids of varying size can form within a copper through-hole fill.

Conventional pulse plating reverse (PPR) plating processes also fail to fill the high aspect ratio through-holes. Phase shift PPR techniques have been used to initially form a complete copper bridge at the center of through-holes to form two vias followed by DC plating to fill the vias. Phase shift pulse plating is a technique where the same pulse waveform is applied to each side of the substrate (controlled by separate rectifiers) and the waveforms are offset to a certain degree (eg. 0°, 90° and 180°). Phase shift refers to the difference in starting times of the pulse expressed as an angle being the fraction of a full cycle of 360°. However, such phase shift PPR plating processes are not always reliable and often result in incomplete through-hole filling with significant formation of undesirable voids in the copper fill.

An ideal process completely fills through-holes with a high degree of planarity, i.e., build up consistency, without voids to provide optimum reliability and electrical properties and at a low surface thickness for optimum line width and impedance control in an electrical device.

Accordingly, there is a need for a method to improve high aspect ratio through-hole filling in substrates, such as printed circuit boards.

SUMMARY OF THE INVENTION

A method comprising:

a) providing a substrate comprising a first side and a second side with a plurality of through-holes;

b) immersing the substrate in a copper plating bath;

c) simultaneously polarizing the first side of the substrate with a rectifier and polarizing the second side of the substrate with the rectifier to generate an electrical current on the first and second side of the substrate;

d) plating a partial copper bridge in the through-holes by simultaneously applying a plating cycle to the first side and the second side of the substrate comprising applying DC current on the first side and the second side of the substrate followed by applying a first pulse-train on the first side of the substrate and a second pulse-train on the second side of the substrate, the first pulse-train and the second pulse-train are offset by 180°; and then, e) filling the through-holes with copper by applying a pulse plating reverse current to the substrate.

Until now it was thought that the through-holes had to be completely bridged before switching to the next step of filling the through-holes. However, the method of the present invention shows partial bridging of the through-holes followed by completely filing the through-holes by using pulse plating reverse can enable defect free filling with lower surface copper.

DETAILED DESCRIPTION OF THE INVENTION

As used throughout this specification, the abbreviations given below have the following meanings, unless the context clearly indicates otherwise: g=gram; mL=milliliter; L=liter; cm=centimeter; μm=micron; ppm=parts per million=mg/L; ppb=parts per billion; ° C.=degrees Centigrade; g/L=grams per liter; DC=direct current; PPR=pulse plating reverse; ASD=amperes/dm$^2$; AR=aspect ratio; 2D=two-dimensional; DI=deionized; sec=second; ms=millisecond; wt %=percent by weight; and void=a space free of copper within a through-hole otherwise filled with copper metal.

The terms "printed circuit board" and "printed wiring board" are used interchangeably throughout this specification. The term "substrate" includes, but is not limited to, printed circuit boards metallized with electroless or SHADOW and glass metallized with electroless. The term "SHADOW" means an electrically conductive graphite surface. The terms "plating" and "electroplating" are used interchangeably throughout this specification. The terms "compositions" and "bath" are used interchangeably throughout this specification. The term "pulse-train" means a sequence of forward (cathodic)-reverse (anodic) current pulses of a predetermined current density and over a predetermined time-period. The term "phase shift" is the difference in starting times of the applied waveform expressed as an angle being the fraction of a full cycle of 360°. The term "aspect ratio" means thickness of the through-hole/diameter of the through-hole. The term "cycle" means a series of events that are repeated in the same order. The term "DC current" means a one-directional flow of electric current. The term "pulse plating reverse" means an electroplating process where electrical current is alternated between a cathodic current (forward pulse) and an anodic current (reverse pulse) during the electroplating process. The term "voids" within the scope of the present invention means a space or pocket substantially free of copper deposit but is within a copper deposit. The term "pitch" means a frequency of through-hole positions from each other on a substrate. The term "conformal plating" means copper plates (deposits) to the contours of a substrate surface. The term "immediately" means that there are no intervening steps. All amounts are percent by weight, unless otherwise noted. All numerical ranges are inclusive and combinable in any order except where it is logical that such numerical ranges are constrained to add up to 100%.

Figure 2:
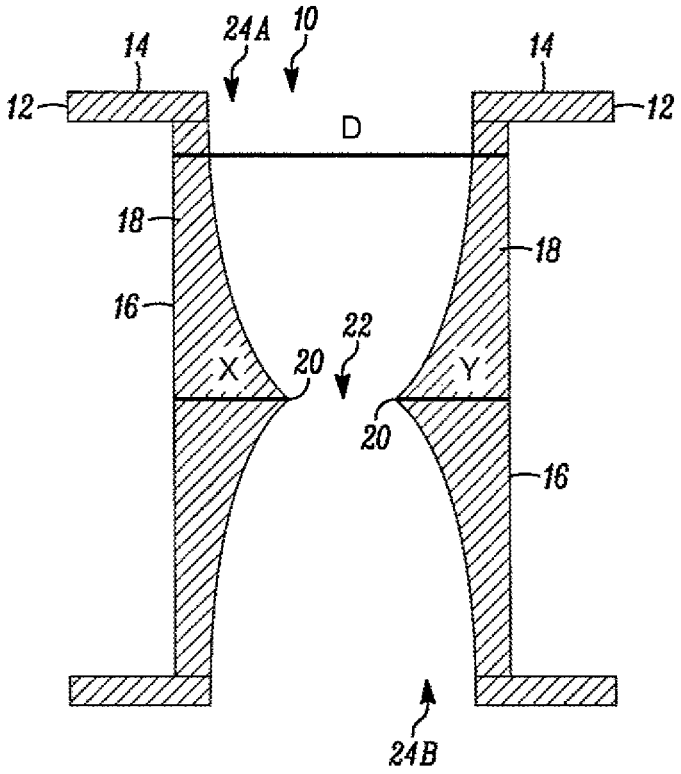
FIG. 2 illustrates a cross-section of a through-hole of a partial copper bridge.

Phase shift electroplating is done simultaneously on a first side or side A of a substrate and on a second side or side B of a substrate during formation of a partial bridge in through-holes of the substrate. Electroplating on each side of the substrate includes (preferably consists of) DC electroplating where copper is deposited on a surface of the substrate and walls of through-holes followed by a pulse-train where copper is stripped from the surface of the substrate and the walls of the through-holes. The cycle of DC plating followed by the pulse-train is repeated simultaneously on both sides of the substrate until a partial bridge is formed in the through-holes. FIG. 2 is an example of a cross-section of a through-hole 10 with a partial bridge 20. The surface of the substrate 12 is plated with copper 14 and the walls 16 of the through-hole 10 are plated with copper 18 such that a partial bridge 20 is formed substantially at the center of the through-hole 10 where a gap 22 is left between each half of the partial bridge. The through-hole 10 has an opening 24A and 24B at both ends.

Figure 1A:
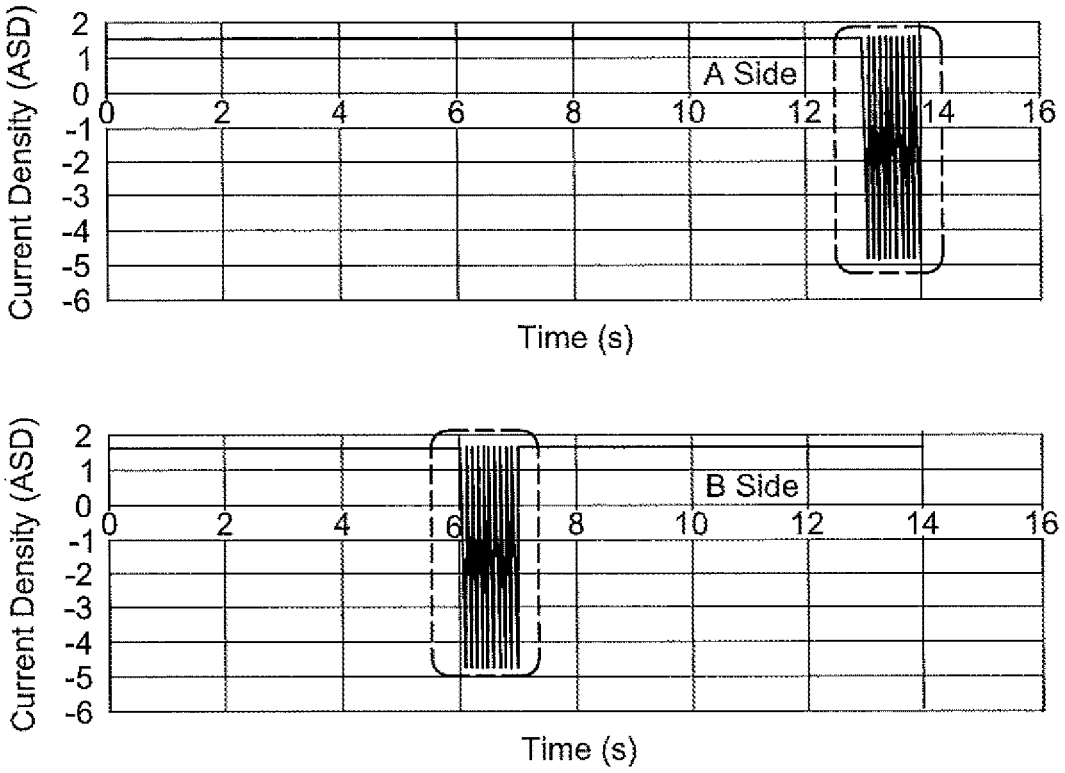
FIG. 1A illustrates phase shift waveforms of current density versus time in seconds on sides A and B of a substrate with a plurality of through-holes wherein the phase shift waveforms are off-set by 180°.

At least one pulse-train on the first side or A side of the substrate is off-set to the at least one pulse-train on the second side or side B of the substrate by a phase shift of 180°. The waveform is such that DC plating predominates on both the sides of the substrate during the method. First side (A) or second side (B) of the substrate can start with DC plating. While DC plating is done on one side of the substrate, simultaneously, a pulse train of forward (cathodic)-reverse (anodic) current (striping copper) is done on the other side of the substrate. After a predetermined period, the side of the substrate where DC plating was done is changed to a pulse train of forward (cathodic)-reverse (anodic) current (striping copper) and DC plating is done on the opposite side where the pulse train was previously applied. For example, if the second side (B) begins with DC plating, simultaneously, the pulse train is applied to the first side (A). After a predetermined period, the first side (A) continues with DC plating while, simultaneously, a pulse train of forward (cathodic)-reverse (anodic) current (striping copper) is applied to the second side (B) of the substrate. The pulse train on the first side of the substrate and the pulse train on the second side of the substrate occur at predetermined time intervals through-out the phase shift cycle and the cycle covers 360°. FIG. 1A is an example of one cycle showing DC current followed by pulse-trains of forward-reverse current with a phase shift of 180°, wherein electroplating is done simultaneously on both sides of a substrate having a plurality of through-holes.

A conventional electroplating apparatus can be used to plate the through-holes. An apparatus which can be used to electroplate a substrate including a plurality of through-holes includes a rectifier to provide a voltage drop on each side of the substrate (cathode). The rectifier is electrically connected to a counter electrode or anode. The substrate and the counter electrode are immersed in a container containing a copper electroplating bath or composition.

During the phase shift cycle, preferably, DC current density ranges from 0.5 to 10 ASD, more preferably, from 1 to 5 ASD, most preferably from 1 to 3ASD. Preferably, during the phase shift cycle, DC current is applied for 1-60 seconds, more preferably, from 1-40 seconds, most preferably, from 1-20 seconds.

During the phase shift cycle, preferably, the pulse-train of forward-reverse current has a forward current density of 0.5 to 10 ASD, more preferably from 1 to 5 ASD, most preferably, from 1 to 3 ASD, and the reverse current density, preferably, has a reverse current density of −1.5 to −30 ASD, more preferably, from −3 to −15 ASD, most preferably, from −3 to −9 ASD. Preferably, the forward to reverse ratio is 1:3. The time for the forward and reverse pulses of the pulse train can be the same or different, preferably, the time for the forward pulse and the reverse pulse is of the same duration. Preferably, the forward pulse and the reverse pulse have a duration of 25-1000 ms, more preferably, from 50-500 ms, most preferably, from 50-200 ms. Pulse-trains are illustrated within the dashed rectangles of FIG. 1A.

A phase shift cycle is repeated until a desired partial bridge is formed in substantially all the through-holes of a substrate. If phase shift plating is too long in duration, voids begin to form in the through-holes because surface roughness increases and leads to void formation at the point of bridging.

A superconformal growth of copper deposit inside a through-hole is when the maximum thickness of the plated deposit inside the through-hole is greater than the deposit thickness on the surface around the through-hole. A partial bridge within the scope of the present invention is a superconformal growth that has a ratio of copper in the through-hole at its thickest point in microns (μm): the diameter of the through-hole in microns (μm) of greater than 0 but less than 1. Preferably, the ratio ranges from greater than 0.25 to less than 0.9. A value of 0 indicates, by definition, no plating in the through-hole. The copper plating on the walls of the through-hole can be either conformal or superconformal. A value of 1 indicates complete bridge formation such that two via are formed in the through-hole. The ratio can be expressed by the following two equations for a cross-section of a through-hole:

$$0 < X + Y/D < 1 \text{ or} \quad \text{(I)}$$

$$0 < (X + Y)/2/D/2 < 1, \quad \text{(II)}$$

where X is the thickest point of the through-hole at one-half of the through-hole and Y is the thickest point of the second half of the through-hole opposite X and D is the diameter of the through-hole prior to plating.

Figure 3:
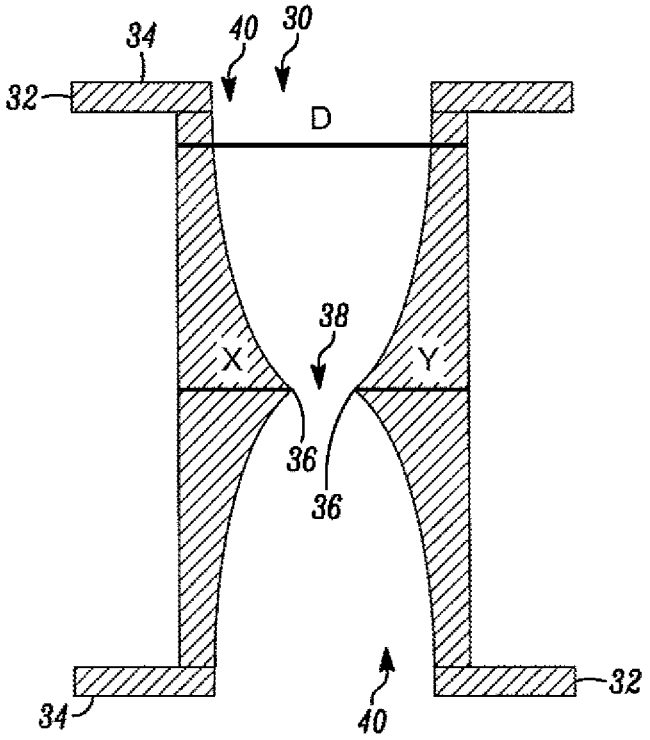
FIG. 3 illustrates a cross-section of a through-hole of a partial copper bridge designating variables X and Y for determining the partial copper bridge parameter.

FIG. 3 illustrates a cross-section of a through-hole 30 in a substrate 32 plated with a layer of copper 34 and a partial copper bridge 36 of half X and half Y and diameter D. The partial copper bridge 36 forms a FIG. 8 configuration within the through-hole 30 with a gap 38 between the two thickest points in the through-hole. The through-hole 30 has two open ends 40.

Figure 4:
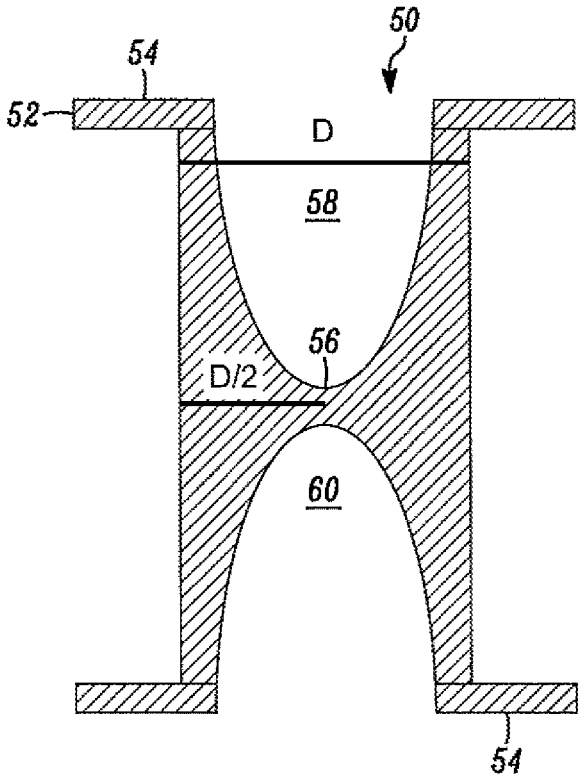
FIG. 4 illustrates a cross-section of a through-hole of a complete copper bridge.

In contrast, FIG. 4 illustrates a through-hole 50 in a substrate 52 plated with a layer of copper 54 and a complete copper bridge 56 which forms two via 58 and 60. Here, the ratio is 1.

The means of measuring the through-hole parameters for determining the ratio is not limited. For example, cross-sections of the through-holes can be made and the two halves of the through-holes measured at the thickest points. Preferably, the parameters are measured by X-Ray analysis such as with Nordson Dage QUADRA™ 5 X-Ray inspection system. The X-Ray analysis enables 2D analysis of through-holes.

Figure 1B:
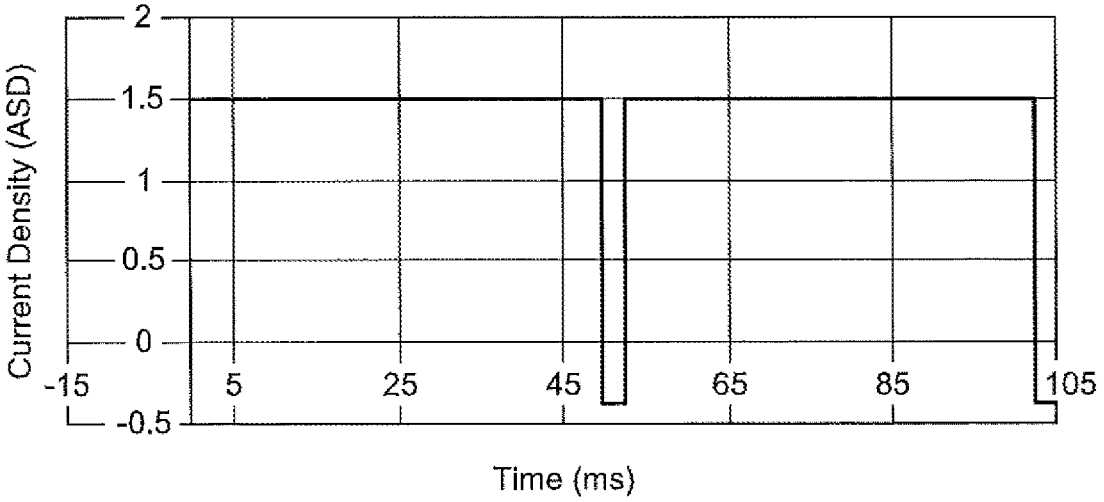
FIG. 1B illustrates a pulse plating reverse waveform of current density versus time for completely filling the through-holes with partial copper bridges.

After partial bridging of through-holes is substantially complete, filling of the through-holes with copper is completed by pulse plating reverse (PPR). In the PPR phase of filling through-holes of the present invention, a forward pulse current is applied followed by a reverse pulse current. No DC current is applied during the PPR phase of filling through-holes of the present invention. FIG. 1B illustrates a PPR cycle of forward pulse current followed by reverse pulse current then a second forward current then a second reverse current. The PPR cycle can be repeated until the through-holes are filled with copper.

Forward pulse current ranges from 0.5 to 10 ASD, more preferably, from 1 to 5 ASD, most preferably from 1 to 3ASD. Preferably, forward current is applied for 10-100 ms, more preferably, from 10-80 ms, most preferably, from 15-50 ms. Preferably, reverse or anodic current ranges from −0.15 to −2.5 ASD, more preferably, from −0.25 to −1.25 ASD, most preferably, from −0.25 to −0.75 ASD. Preferably, the forward to reverse current ratio is 1:0.25. Preferably, reverse current is applied, preferably, from 1-10 ms, more preferably, from 1-5 ms, most preferably, from 1-3 ms.

Preferably, the substrate is a printed circuit board or wiring board with an average thickness of preferably 150-800 μm, more preferably, from 250-800 μm, most preferably 250-400 μm. Preferably, the through-holes have an average diameter of 100-300 μm, more preferably, from 100-250 μm, most preferably, 200-250 μm.

Printed Circuit boards having a thickness of 250 μm with average through-hole diameters of 100 μm and a plated surface copper thickness of 3-9 μm have a ratio of copper in the through-hole at its thickest point: the diameter of the through-hole of 0.28-0.80. Boards with a thickness of 250 μm with average through-hole diameters of 150 μm and plated surface copper thickness of 7-9 μm have a ratio of 0.48-080. Boards having a thickness of 400 μm with average through-hole diameters of 200 μm and a plated surface copper thickness of 10 μm to 13 μm have a ratio of 0.48-0.70. Boards having a thickness of 800 μm with average through-hole diameters of 250 μm and a plated surface copper thickness of 10-14 μm have a ratio of 0.69-0.85.

Preferably, the AR is from 1.6:1-5:1, more preferably, 1.2:1-2.6:1, most preferably, the AR is 1.6:1-2:1.

Preferably, the pitch of the through-holes is 200-1000 μm, more preferably, 300-1000 μm, most preferably, 500-1000 μm.

Copper layer thickness and presence of voids in through-holes can be measured using conventional methods. An example of a conventional method for measuring copper layer thickness and presence of voids is X-ray analysis.

Preferably the copper electroplating bath is agitated during the electroplating method of filling the through-holes to encourage copper bath additives to be uniformly deposited over the surface of the substrate and in the through-holes. Any conventional plating bath agitation apparatus can be used. Preferably, bath agitation is 4 L/min to 24 L/min, more preferably, 4 L/min to 16 L/min. Preferably, plating temperatures range from 15-30 °C, more preferably from room temperature to 30 °C Prior to filling through-holes, substrates are preferably plated with a layer of electroless copper such that the electroless copper is adjacent a surface of the substrate and the walls of the through-holes. Conventional electroless copper plating baths as well as conventional electroless plating methods can be used to deposit the copper layer. Such electroless copper baths and methods are well known in the art and literature. An example of a commercially available electroless copper bath is CIRCUPOSIT™ 253 Electroless Process plating formulation and method (available from DuPont Electronics & Industrial, Marlborough, MA). Preferably, the electroless copper has a thickness of 0.25 μm to 6 μm, more preferably, from 0.25 μm to 3 μm.

Substrates preferably contain thermosetting resins, thermoplastic resins and combinations thereof, including fiber, such as fiberglass, and impregnated embodiments of the foregoing.

Thermoplastic resins include, but are not limited to acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates and polyesters.

Conventional acid copper electroplating baths for plugging and filling through-holes can be used. In addition to sources of copper ions, preferably, the copper electroplating baths include one or more brighteners, levelers and suppressors. Conventional brighteners, levelers and suppressors can be used.

Sources of copper ions include, but are not limited to water soluble halides, nitrates, acetates, sulfates and other organic and inorganic salts of copper. Mixtures of one or more of such copper salts may be used to provide copper ions. Examples include copper sulfate, such as copper sulfate pentahydrate, copper chloride, copper nitrate, copper hydroxide and copper sulfamate. Conventional amounts of copper salts may be used in the compositions. Copper salts are included in the bath in amounts of 50 g/l to 350 g/L, typically 100 g/L to 250 g/L.

Acids include, but are not limited to sulfuric acid, hydrochloric acid, hydrofluoric acid, phosphoric acid, nitric acid, sulfamic acid and alkylsulfonic acids. Such acids are included in conventional amounts. Preferably, such acids are included in the acid copper baths in amounts of 25 g/l to 350 g/L.

Brighteners include, but are not limited to 3-mercapto-propylsulfonic acid and its sodium salt, 2-mercapto-ethanesulfonic acid and its sodium salt, and bissulfopropyl disulfide and its sodium salt, 3-(benzthiazoyl-2-thio)-propylsulfonic acid sodium salt, 3-mercaptopropane-1-sulfonic acid sodium salt, ethylenedithiodipropylsulfonic acid sodium salt, bis-(p-sulfophenyl)-disulfide disodium salt, bis-(ω-sulfobutyl)-disulfide disodium salt, bis-(ω-sulfohydroxypropyl)-disulfide disodium salt, bis-(ω-sulfopropyl)-disulfide disodium salt, bis-(ω-sulfopropyl)-sulfide disodium salt, methyl-(ω-sulfopropyl)-disulfide sodium salt, methyl-(ω-sulfopropyl)-trisulfide disodium salt, O-ethyl-dithiocarbonic acid-S-(ω-sulfopropyl)-ester, potassium salt thioglycolic acid, thiophosphoric acid-O-ethyl-bis-(ω-sulfpropyl)-ester disodium salt, thiophosphoric, acid-tris(ω-sulfopropyl)-ester trisodium salt, N,N-dimethyldithiocarbamic acid (3-sulfopropyl) ester, sodium salt, (O-ethyldithiocarbonato)-S-(3-sulfopropyl)-ester, potassium salt, 3-[(amino-iminomethyl)-thio]-1-propanesulfonic acid and 3-(2-benzthiazolylthio)-1-propanesulfonic acid, sodium salt. Preferably the brightener is bissulfopropyl disulfide or its sodium salt. Preferably, the brighteners are included in amounts of 1 ppb to 500 ppm, preferably from 50 ppb to 10 ppm.

Conventional levelers can be used in the copper electroplating baths. Levelers included in the acid copper electroplating baths for filling through-holes are preferably reaction products of heterocyclic aromatic compounds with epoxy compounds. An example of a preferred copolymer of an aromatic compound with an epoxy compound used as a leveler is 4-phenylimidazole/imidazole/1,4-butandiol diglycidyl ether copolymer. Synthesis of such compounds is disclosed in the literature such as in U.S. Pat. No. 8,268,158.

Other additives which may be included in the acid copper electroplating baths are one or more conventional compounds often included in acid copper electroplating baths and compositions. Such conventional compounds include, but are not limited to, one or more complexing agents, one or more sources of chloride ions, stabilizers such as those which adjust mechanical properties, provide rate control, refine grain structure and modify deposit stress, buffering agents, suppressors and carriers. They may be included in the acid copper electroplating baths in conventional amounts well known to those of skill in the art.

The methods of the present invention reduce number and size of voids and can eliminate voids from through-holes as well as reduce the total surface copper needed to fill the through holes.

The following Examples are included to further illustrate the invention but are not intended to limit its scope.

Invention Examples 1-4 and Comparative Examples 5-7

FR4/glass-epoxy coupons 5 cm wide, 15 cm long with a plurality of through-holes was provided by Cirexx. The Through-hole pitch for each coupon was 1000 μm. The coupons were initially plated with CIRCUPOSIT™ 253 Electroless Process plating formulation and method (available from DuPont Electronics & Industrial, Marlborough, MA) to form an electroless copper layer on both sides of the coupons and on the walls of the through-holes. The thickness of the electroless copper layer on the coupons was about 0.3 μm. The coupons were pre-cleaned using LP200 and EVP-209 copper cleaners available from DuPont Electronics & Industrial, Inc. The coupons were then placed in 32 L plating tanks which contained aqueous based copper electroplating baths with a formula as shown in Table 1 with a pH of less than 1.

TABLE 1

| COMPONENT | AMOUNT |
|---|---|
| Copper sulfate pentahydrate | 220 g/L |
| Sulfuric acid | 40 g/L |
| Chloride ion from hydrochloric acid | 50 ppm |
| Polyethylene glycol | 1 g/L |
| 4-phenylimidazole/imidazole/1,4-butandiol diglycidyl ether copolymer | 10 mg/L |
| Bis-sodium sulfopropyl)-disulfide | 2 mg/L |

The coupons were connected to DRPP (Dutch Reverse Pulse Plating) rectifiers. One side of each coupon (side A) was connected to one rectifier and the second side of each coupon (side B) was connected to a second rectifier to enable independent control of current application to each side of the coupons. Each 32 L plating tank included two DeNora DT-4 iridium coated titanium insoluble anode counter electrodes. Each electrode was connected to one of the two rectifiers to provide a voltage to the electrodes. The plating baths were agitated during electroplating using educators at 16 L/minute. Electroplating was done at room temperature. Copper electroplating on the coupons and on the through-hole walls occurred during DC plating while copper stripping occurred during the forward-reverse pulse plating.

Through-hole analysis and copper thickness were measured by X-Ray analysis using Nordson Dage QUADRA™ 5 2D X-Ray inspection system. Partial copper bridge measurements were based on the following equation:

$$0 < (X + Y)/2/D/2 < 1 \quad \text{(II)}$$

where the parameters X, Y and D are defined above.

Example 1 (Invention)

FR4/glass-epoxy coupons with a plurality of through-holes 250 μm thick and having diameters of 100 μm were copper plated to form partial bridges in the through-holes followed by complete through-hole fill. The AR=2.5. FIG. 1A illustrates the first step of the plating method of the invention. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 2. The dashed rectangles in FIG. 1A illustrate an example of the forward-reverse pulse plating sequences.

TABLE 2

| | |
|---|---|
| FORWARD CURRENT | 1.5 ASD |
| FORWARD PULSE TIME | 125 ms |
| REVERSE CURRENT | −4.5 ASD |
| REVERSE PULSE TIME | 125 ms |

After a period of about 1 sec, the forward-reverse pulse plating sequence on side B was changed back to DC plating. After about 13 sec the DC plating on side A was changed from DC plating to forward-reverse pulse plating for about 1 sec having the same parameters as in Table 2 above. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 3 μm was deposited on the surface of sides A and B of half the coupons, while a copper layer of about 9 μm was deposited on the other half of the coupons.

X-ray analysis was used to measure the partial copper bridge as well as any voids in the through-holes. All the through-holes showed partial bridge formation. The coupons with the 3 μm copper surface layer had D/2=50 μm and (X+Y)/2=14 μm. The ratio=0.28. The coupons with the 9 μm copper surface layer had D/2=50 μm and (X+Y)/2=40 μm. The ratio=0.80. No voids were detected in the through-holes. The through-hole is opened at both ends with two side walls plated with copper. The partial copper bridge is formed substantially at the center of the through-hole with a gap or opening between each half of the partial bridge.

Electroplating to completely fill the through-holes of the coupons was done by pulse plating reverse. FIG. 1B illustrates a pulse plating waveform. Table 3 below discloses the plating parameters.

TABLE 3

| | |
|---|---|
| FORWARD PULSE DURATION | 50 ms |
| FORWARD CURRENT | 1.5 ASD |
| REVERSE PULSE DURATION | 2.5 ms |
| REVERSE CURRENT | −0.375 ASD |

The pulse plating reverse cycle was repeated until a surface copper thickness on all the coupons reached about 40 μm. The through-holes were examined for voids by X-ray analysis. All the through-holes appeared filled and no voids were observed.

Example 2 (Invention)

FR4/glass-epoxy coupons with a plurality of through-holes 250 μm thick and having diameters of 150 μm were copper plated to form partial bridges in the through-holes followed by complete through-hole fill. The AR=1.7. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 2 in Example 1.

After a period of about 1 sec, the forward-reverse pulse plating sequence on side B was changed back to DC plating. After about 13 sec the DC plating on side A was changed from DC plating to forward-reverse pulse plating for about 1 sec having the same parameters as in Table 2 in Example 1 above. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 7 μm was deposited on the surface of sides A and B of half the coupons, while a copper layer of about 9 μm was deposited on the other half of the coupons.

X-ray analysis was used to measure the partial copper bridge as well as any voids in the through-holes. All the through-holes showed partial bridge formation. The coupons with the 7 μm copper surface layer had D/2=75 μm and (X+Y)/2=36 μm. The ratio=0.48. The coupons with the 9 μm copper surface layer had D/2=75 μm and (X+Y)/2=60 μm. The ratio=0.80. No voids were detected in the through-holes. The through-hole is opened at both ends with two side walls plated with copper. The partial copper bridge is formed substantially at the center of the through-hole with a gap or opening between each half of the partial bridge.

Electroplating to completely fill the through-holes of the coupons was done by pulse plating reverse. Table 3 in Example 1 above discloses the plating parameters. The pulse plating reverse cycle was repeated until a surface copper thickness on all the coupons reached about 40 μm. The through-holes were examined for voids by X-ray analysis. All the through-holes appeared filled and no voids were observed.

Example 3 (Invention)

FR4/glass-epoxy coupons with a plurality of through-holes 400 μm thick and having diameters of 200 μm were copper plated to form partial bridges in the through-holes followed by complete through-hole fill. The AR=2. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 2 in Example 1.

After a period of about 1 sec, the forward-reverse pulse plating sequence on side B was changed back to DC plating. After about 13 sec the DC plating on side A was changed from DC plating to forward-reverse pulse plating for about 1 sec having the same parameters as in Table 2 in Example 1 above. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 10 μm was deposited on the surface of sides A and B of half the coupons, while a copper layer of about 13 μm was deposited on the other half of the coupons.

X-ray analysis was used to measure the partial copper bridge as well as any voids in the through-holes. All the through-holes showed partial bridge formation. The coupons with the 3 μm copper surface layer had D/2=100 μm and (X+Y)/2=48 μm. The ratio=0.48. The coupons with the 13 μm copper surface layer had D/2=200 μm and (X+Y)/2=70 μm. The ratio=0.70. No voids were detected in the through-holes. The through-hole is opened at both ends with two side walls plated with copper. The partial copper bridge is formed substantially at the center of the through-hole with a gap or opening between each half of the partial bridge.

Electroplating to completely fill the through-holes of the coupons was done by pulse plating reverse. Table 3 in Example 1 above discloses the plating parameters. The pulse plating reverse cycle was repeated until a surface copper thickness on all the coupons reached about 40 μm. The through-holes were examined for voids by X-ray analysis. All the through-holes appeared filled and no voids were observed.

Example 4 (Invention)

FR4/glass-epoxy coupons with a plurality of through-holes 800 μm thick and having diameters of 250 μm were copper plated to form partial bridges in the through-holes followed by complete through-hole fill. The AR=3.2. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 2 in Example 1.

After a period of about 1 sec, the forward-reverse pulse plating sequence on side B was changed back to DC plating. After about 13 sec the DC plating on side A was changed from DC plating to forward-reverse pulse plating for about 1 sec having the same parameters as in Table 2 in Example 1 above. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 10 μm was deposited on the surface of sides A and B of half the coupons, while a copper layer of about 14 μm was deposited on the other half of the coupons.

X-ray analysis was used to measure the partial copper bridge as well as any voids in the through-holes. All the through-holes showed partial bridge formation. The coupons with the 10 μm copper surface layer had D/2=125 μm and (X+Y)/2=87 μm. The ratio=0.70. The coupons with the 14 μm copper surface layer had D/2=125 μm and (X+Y)/2=107 μm. The ratio=0.86. No voids were detected in the through-holes. The through-hole is opened at both ends with two side walls plated with copper. The partial copper bridge is formed substantially at the center of the through-hole with a gap or opening between each half of the partial bridge.

Electroplating to completely fill the through-holes of the coupons was done by pulse plating reverse. Table 3 in Example 1 above discloses the plating parameters. The pulse plating reverse cycle was repeated until a surface copper thickness on all the coupons reached about 40 μm. The through-holes were examined for voids by X-ray analysis. All the through-holes appeared filled and no voids were observed.

Example 5 (Comparative)

FR4/glass-epoxy coupons with a plurality of through-holes 250 μm thick and having diameters of 100 μm were copper plated to form complete bridges in the through-holes followed by complete through-hole fill. The AR=2.5. FIG. 1A illustrates the first step of the plating method of the invention. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 4.

TABLE 4

| | |
|---|---|
| FORWARD CURRENT | 1.5 ASD |
| FORWARD PULSE TIME | 125 ms |
| REVERSE CURRENT | −4.5 ASD |
| REVERSE PULSE TIME | 125 ms |

Alter a period of about 1 sec, the forward-reverse pulse plating sequence on side B was changed back to DC plating. After about 13 sec the DC plating on side A was changed from DC plating to forward-reverse pulse plating for about 1 sec having the same parameters as in Table 4 above. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 11 μm was deposited on the surface of sides A and B of the coupons.

To determine if complete bridges were formed in the through-holes, the coupons were analyzed by X-ray analysis. All the through-holes showed complete bridge formation. FIG. 4 illustrates a cross-section of a through-hole with a complete bridge. The through-hole is opened at both ends to form two via with two side walls plated with copper. The copper bridge is formed substantially at the center of the through-hole. The bridge ratio was equal to 1. No voids were detected in the through-holes.

Figure 5:
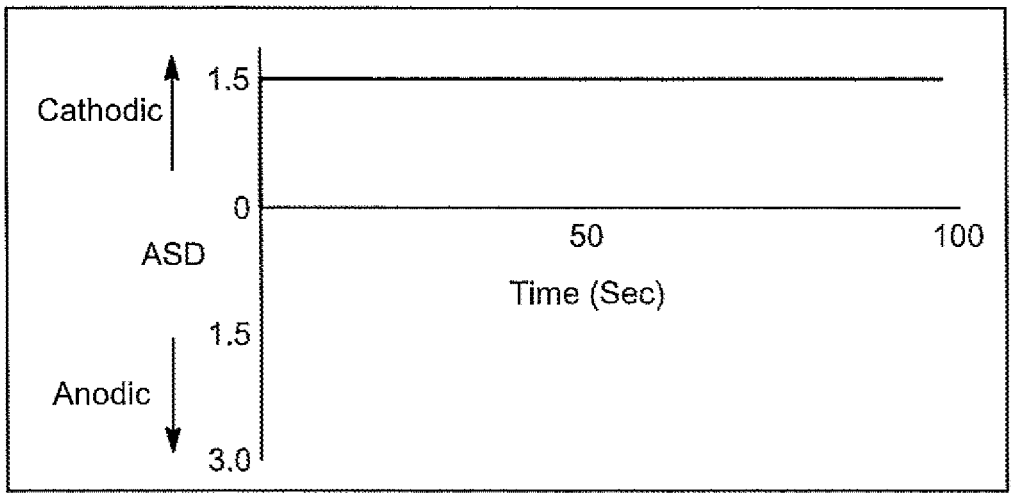
FIG. 5 illustrates a DC waveform of current density versus time in seconds for filling through-holes having a complete copper bridge.

Electroplating to completely fill the through-holes was done by DC plating. FIG. 5 illustrates a DC waveform. DC plating was done at a current density of 1.5 ASD for 100 sec to deposit a final copper thickness on sides A and B of the substrate of about 40 μm. The coupons were examined for through-hole copper fill and voids. The through-holes were filled with copper; however, substantial voiding was observed in the through-holes.

Example 6 (Comparative)

FR4/glass-epoxy coupons with a plurality of through-holes 250 μm thick and having diameters of 150 μm were copper plated to form complete bridges in the through-holes followed by complete through-hole fill. The AR=1.7. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 4 in Example 5.

After a period of about 1 sec, the forward-reverse pulse plating sequence on side B was changed back to DC plating. After about 13 sec the DC plating on side A was changed from DC plating to forward-reverse pulse plating for about 1 sec. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 10 μm was deposited on the surface of sides A and B of the coupons.

X-ray analysis was used to determine through-hole bridging. All the through-holes showed complete bridge formation. The bridge ratio was equal to 1. No voids were detected in the through-holes.

Electroplating to completely fill the through-holes was done by DC plating. DC plating was done at a current density of 1.5 ASD for 100 sec to deposit a final copper thickness on sides A and B of the substrate of about 40 μm. The coupons were examined for through-hole copper fill and voids. The through-holes were filled with copper; however, substantial voiding was observed in the through-holes.

Example 7 (Comparative)

FR4/glass-epoxy coupons with a plurality of through-holes 400 μm thick and having diameters of 200 μm were copper plated to form complete bridges in the through-holes followed by complete through-hole fill. The AR=2. Both sides of each coupon were simultaneously polarized with the application of a voltage generated by the rectifiers to enable a DC current across sides A and B of each coupon. The DC current was set at 1.5 ASD. DC current was applied to side A of each coupon for about 13 sec and on side B for about 6 sec after which the rectifier for side B was switched from DC plating to a forward-reverse pulse plating sequence having the parameters disclosed in Table 4 in Example 5 above.

After a period of about 1 sec, the forward-reverse pulse plating sequence on side B was changed back to DC plating. After about 13 sec the DC plating on side A was changed from DC plating to forward-reverse pulse plating for about 1 sec. The phase shift off-set for the forward-reverse pulse plating of side A to side B was 180°.

The foregoing electroplating cycle of DC current followed by forward-reverse pulse plating with a phase shift off-set of 180° of sides A to B of the coupons was repeated until a copper layer of about 15 μm was deposited on the surface of sides A and B of the coupons.

X-ray analysis was used to determine through-hole bridging. All the through-holes showed complete bridge formation. The bridge ratio was equal to 1. No voids were observed.

Electroplating to completely fill the through-holes was done by DC plating. DC plating was done at a current density of 1.5 ASD for 100 sec to deposit a final copper thickness on sides A and B of the substrate of about 40 μm. The coupons were examined for through-hole copper fill and voids. The through-holes were filled with copper. Some voids were observed.

What is claimed is:

1. A method comprising:

a) providing a substrate comprising a first side and a second side with a plurality of through-holes;

b) immersing the substrate in a copper plating bath;

c) simultaneously polarizing the first side of the substrate with a rectifier and polarizing the second side of the substrate with the rectifier to generate an electrical current on the first and second side of the substrate;

d) plating a partial copper bridge in the plurality of through-holes by simultaneously applying a plating cycle to the first side and the second side of the substrate comprising applying DC current on the first side and the second side of the substrate followed by applying a first pulse-train on the first side of the substrate and a second pulse-train on the second side of the substrate, the first pulse-train and the second pulse-train are offset by 180° of the plating cycle, wherein in the plating cycle, DC current is applied on the first side of the substrate while applying the second pulse-train on the second side of the substrate, and DC current is applied on the second side of the substrate while applying the first pulse-train on the first side of the substrate; and then, e) filling the through-holes with copper by applying a pulse plating reverse current to the substrate.

2. The method of claim 1, wherein a DC current density on the first side and the second side of the substrate ranges from 0.5 ASD to 10 ASD.

3. The method of claim 1, wherein the pulse-train on the first side and the pulse-train on the second side of the substrate have a forward current density of 0.5 ASD to 10 ASD and a reverse current density of −1.5 ASD to −30 ASD.

4. The method of claim 1, wherein the pulse plating reverse current has a forward current density of 0.5 ASD to 10 ASD and a reverse current density of −0.15 ASD to −2.5 ASD.

5. The method of claim 1, wherein the substrate has a thickness of 150-800 μm.

6. The method of claim 1, wherein the plurality of through-holes has an average diameter of 100-300 μm.

7. The method of claim 1, wherein the partial copper bridge has a partial bridge ratio of greater than 0 but less than 1.

8. The method of claim 1, wherein the plurality of through-holes have an aspect ratio of 1.6:1 to 5:1.

9. The method of claim 1, wherein the first pulse train and the second pulse train result in a net stripping of copper from the first side of the substrate and the second side of the substrate, respectively.

* * * * *